US005394897A

United States Patent [19]

Ritchey et al.

[11] Patent Number: 5,394,897

[45] Date of Patent: Mar. 7, 1995

[54] TENT SYSTEM

[76] Inventors: Michael T. Ritchey, 3657 W. Saragosa, Chandler, Ariz. 85266; Bryce J. Leavitt, 1546 N. Arthur, Pocatello, Id. 83204

[21] Appl. No.: 84,358

[22] Filed: Jun. 28, 1993

[51] Int. Cl.[6] ..... E04H 15/18

[52] U.S. Cl. ..... 135/124; 135/117; 135/119; 135/97; 52/79.8

[58] Field of Search ..... 135/97, 908, 907, 103, 135/102, 117, 119, 120; 52/79.8, 79.7

[56] References Cited

U.S. PATENT DOCUMENTS

| | | | |
|---|---|---|---|
| 3,397,710 | 8/1968 | McElroy . | |
| 3,699,986 | 10/1972 | Kirkham . | |
| 3,802,133 | 5/1974 | Gregory | 135/102 |
| 3,874,396 | 4/1975 | Kirkham . | |
| 3,955,328 | 5/1976 | Lindsay | 52/79.8 |
| 4,063,566 | 12/1977 | Millerioux . | |
| 4,078,572 | 3/1978 | Moss | 135/105 |
| 4,815,490 | 3/1989 | Söderström | 135/97 |
| 4,886,084 | 12/1989 | Lawrence et al. | 135/103 |
| 4,979,532 | 12/1990 | Johansson et al. | 135/119 |
| 5,078,096 | 1/1992 | Bishop et al. | 135/102 |
| 5,222,513 | 6/1993 | Hilliard | 135/97 |

*Primary Examiner*—Carl D. Friedman
*Assistant Examiner*—Wynn E. Wood
*Attorney, Agent, or Firm*—Lowell W. Gresham; Jordan M. Meschkow

[57] ABSTRACT

A tent system interconnects any number of stand-alone tents (12) to form a tent network (10). The tents (12) are interconnected through connection modules (14). The tents (12) include at least two and preferably three openings (30) which serve as doorways. Various fasteners attach to the tents (12) near each opening (30). One fastener (54) removably couples to a complimentary fastener (34, 36) on the connection module. Another fastener (72) mates with a complimentary fastener (74) on a door panel (76), and yet another fastener (78) mates with a complimentary fastener (80) on a screen panel (82). The openings (30) are formed in tent panels (26) that slope downward and outward from the top of the tent (12). The connection modules (14) have flexible sheet material (32) sides (38, 40) with ends configured with a downward and inward slope that allows them to mate with the tent panels (26).

19 Claims, 2 Drawing Sheets

TENT SYSTEM

TECHNICAL FIELD OF THE INVENTION

The present invention relates generally to tents. More specifically, the present invention relates to a system for interconnecting stand-alone tents into a tent network.

BACKGROUND OF THE INVENTION

Tents are stand-alone fabric and pole housing structures which are typically used for camping outdoors, play, temporary lodging, or storage. Tents come in a wide variety of shapes and sizes. While most tents form only a single room, multi-room or multi-compartment tents are also known. Tents may accommodate various accessories which are intended to expand the tents' functionality. For example, some tent models include alcoves, canopies, and the like. When compared to more permanent housing structures, tents are inexpensive, lightweight, easily assembled, easily disassembled, and easily stored when disassembled. In short, tents are temporary, portable structures of varying designs and having many uses.

While the existing tent art may be able to suggest a particular tent structure to meet a particular tent need, finding tent structures which meet a variety of tent needs is a serious problem. Of course, one could acquire a variety of tents to meet a variety of tent needs, but this is an undesirably expensive and complicated solution which requires an extensive amount of storage space for tents which are not being used. Accordingly, a need exists for a flexible tent system which meets a variety of tent needs at a reasonable cost and without unduly wasting storage space.

For example, a family or other group of tent occupants may require a tent of one size on one occasion and a tent of another size on another occasion. Or, a family or other group may need one tent for a child's play tent and another tent for family camping. Or, a family or other group may need the individual privacy afforded by separate tents along with the closeness, convenience, security, comfort, and collective privacy achieved by a single tent.

In accordance with prior art tent systems, a group of tent occupants may be forced to have a small tent for one occasion, and one or more larger tents for other occasions. This is an undesirable solution because of the unnecessary expense and excessive storage space required for tents which serve tent needs only on particular occasions. Alteratively, prior art tent systems may force the group to use a variety of tents. However, this is also an undesirable solution because separate tents do not afford the same degree of closeness as a single tent. Moreover, as users travel between diverse separate tents, they do not experience the same degree of privacy and comfort that can be achieved within a single tent.

SUMMARY OF THE INVENTION

Accordingly, it is an advantage of the present invention that an improved tent system is provided.

Another advantage of the present invention is that a tent system which interconnects stand-alone tents is provided.

Yet another advantage is that the present invention provides a connection module which interconnects stand-alone tents.

Still another advantage is that the present invention flexibly interconnects tents to achieve a tent network of any size and having a wide variety of possible configurations.

Still another advantage is that the present invention provides a tent system which permits stand-alone tents to serve a wide variety of tent needs.

Still another advantage is that the present invention provides the closeness and comfort attributes of a single tent with the privacy attributes of different tents.

The above and other advantages of the present invention are carried out in one form by a tent system for interconnecting a plurality of stand-alone tents into a tent network. The tent system includes a flexible sheet material connection module having first and second sides with a common boundary between the first and second sides. The common boundary is the uppermost portion of the sheet material. The first side slopes downward and outward from the common boundary, and the second side slopes downward and outward from the common boundary. The first and second sides have a substantially open end therebetween, and the first and second sides are formed so that this open end slopes downward and inward from the common boundary. A connection module fastening device attaches to the first and second sides of the sheet material near the open end. The fastening device is used to attach the flexible sheet material to a downward and outward sloping surface of a tent.

The above and other advantages of the present invention are carried out in another form by a tent system for interconnecting a plurality of stand-alone tents into a tent network. The tent system includes a first stand-alone tent having first and second openings each of which is configured to permit occupant passage therethrough. A second stand-alone tent also has first and second openings each of which is configured to permit occupant passage therethrough. A connection module removably couples to the first tent at its first opening and removably couples to the second tent at its first opening. The connection module is formed from a flexible sheet material and is dimensioned to permit occupant passage therethrough.

BRIEF DESCRIPTION OF THE DRAWING

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

In the following description of the preferred embodiments, certain items are either structurally similar to, identical to, or mirror images of other items. This description distinguishes such items from their counterparts by the use of lower case alphabetic characters ("a", "b", and so on) which are appended to a common reference number. When an alphabetic character is omitted, the description refers to any one of such items and their counterparts individually or to all of them collectively.

Figure 1:
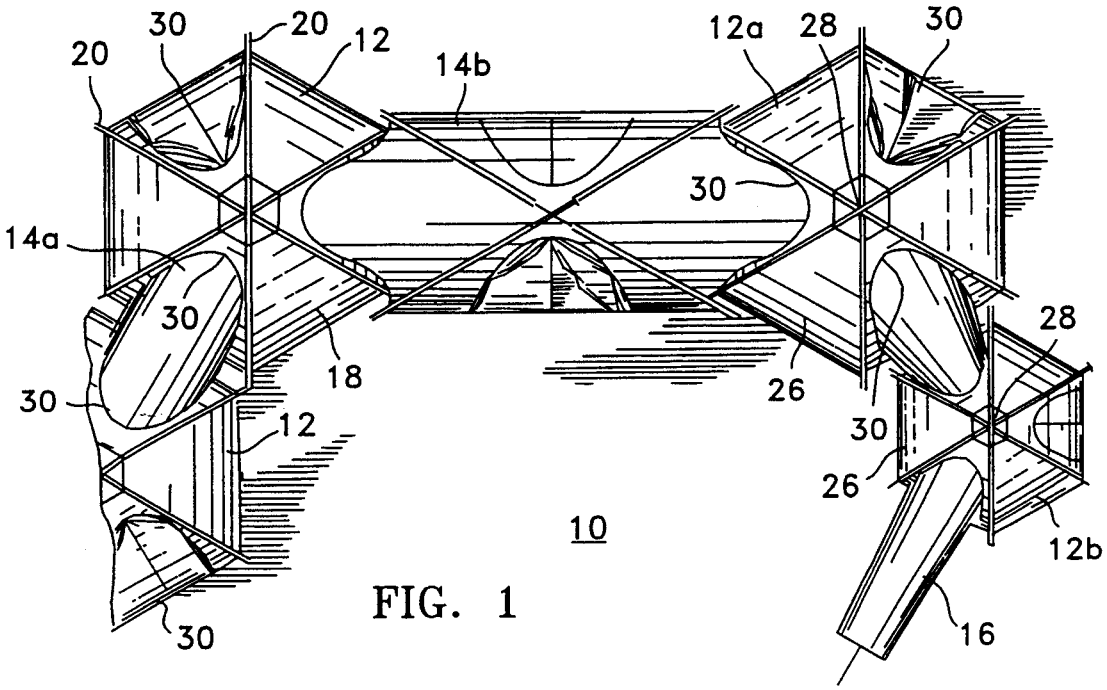
FIG. 1 shows a top view of a tent network formed in accordance with the teaching of the present invention.

FIG. 1 shows a top view of a tent network 10. Tent network 10 includes any number of tents 12 interconnected by connection modules 14. Connection modules may also be configured as accessories 16, which do not interconnect tents but which acts as add-on's to a tent 12. The tent system of the present invention affords great flexibility in interconnecting tents 12. As will be explained in greater detail below, tent network 10 need not have precisely the configuration shown in FIG. 1, and FIG. 2 shows one alternate configuration for tent network 10.

Figure 2:
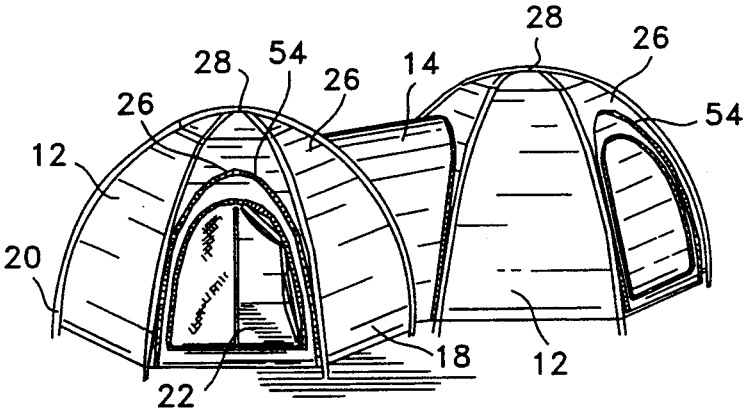
FIG. 2 shows a perspective view of a tent network that includes two stand-alone tents interconnected by a connection module.

With reference to FIGS. 1 and 2, tents 12 are standalone tents in the context of the present invention. In other words, each of tents 12 may be erected and used without the additional supporting structures. Tents 12 do not require the use of connection modules 14 or accessories 16. They may or may not have internal rooms or compartments. As is conventional, tents 12 are constructed from sheet-like, flexible fabric materials 18 and rigid members 20 which serve as tent poles. Using fabric 18 and poles 20, tents 12 substantially enclose an interior space 22. Interior space 22 is desirably large enough to accommodate one or more occupants, whether adults or children.

As is conventional in the art of tent making, each tent 12 includes any number of downward and outward sloping panels 26. Panels 26 slope downward and outward relative to an uppermost region 28 of tent 12. Panels 26 of tents 12 slope downward and outward for many reasons. For example, the downward and outward slope of panels 26 improves the stability of tents 12, increases the floor space inside tents 12, and guides rain away from, rather than toward, the center of tents 12.

FIGS. 1–2 illustrate tents 12 as being "dome" tents. Thus, each panel 26 serves as both a roof and a wall. However, those skilled in the art will appreciate that "cabin" and other tent styles may also suffice for the purposes of the present invention, and that, in some situations, panels 26 may represent walls alone. Moreover, nothing requires all tents 12 in network 10 to have either the same style or the same size. As shown in FIG. 1, network 10 may include tents **12*a* and 12*b*** which are different sizes.

In the preferred embodiments of the present invention, tents 12 each include at least two and preferably three openings 30. Openings 30 accommodate the passage of tent occupants therethrough and may generally be considered doorways. Openings 30 are formed in panels 26 of tents 12. The tent system of the present invention achieves flexibility in configuring tent network 10 through the inclusion of at least two doorways 30 in tents 12. Connection modules 14 may removably couple to tents 12 at doorways 30 as the occupants desire. Connection modules 14 will permit occupant passage therethrough. On the other hand, doorways 30 need not couple to a connection module 14. Consequently, as best viewed in FIG. 1, doorways 30 may be used by occupants to enter and exit tent network 10 and to enter and exit the individual tents 12 of tent network 10.

Tent network 10, as provided by the tent system of the present invention, represents a collection of interconnected tents 12. This permits tents 12 to serve a wider variety of tent needs than are served by conventional tents. For example, in one use for a tent 12, the tent 12 may individually serve a back packing need, which requires a small tent. The same tent may, in a separate use, form part of a relatively large tent network 10. Within tent network 10, each of tents 12 provides the same sense of privacy, separation, and personal space achievable with an individual tent. Thus, even though tents 12 may be a part of network 10, they may serve privacy, separation, or personal space needs otherwise achievable from separate tents. In addition, while still serving individual privacy needs, tent network 10 provides collective privacy and separation from elements outside network 10. In one exemplary use, a portable toilet (not shown) may be placed in one of tents 12 in network 10. This placement keeps the toilet separate from other portions of network 10. An occupant may use the toilet in private, and the occupant may travel to the toilet in privacy, relative to the world outside tent network 10, through a connection module 14.

As shown in FIG. 1, connection module 14 may have several different configurations. For example, a connection module **14*a* connects two, similarly sized tents 12 through openings 30 therein. Connection module 14*a* requires tents 12 to reside near each other and does not include its own opening for entry and exit. A connection module 14*b* also connects two, similarly sized tents 12 together through openings 30 therein. However, connection module 14*b* allows tents 12 to reside farther apart than module 14*a* and includes its own opening for entry and exit. A connection module 14*c* connects two dissimilar sized tents 12**.

Figure 3:
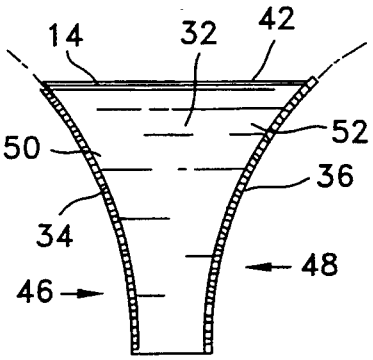
FIG. 3 shows a side view of one embodiment of the connection module.
Figure 4:
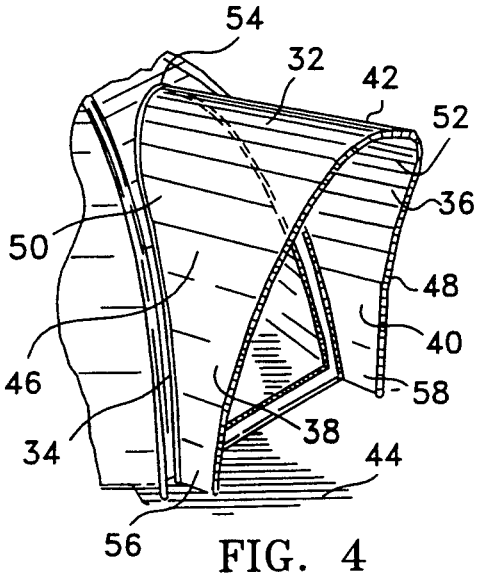
FIG. 4 shows a partial perspective view of a stand-alone tent with the connection module attached thereto.

FIGS. 3 and 4 illustrate features of a first embodiment of connection module 14, particularly connection module **14*a* from FIG. 1. Referring to FIGS. 3 and 4, connection module 14 includes a flexible or fabric sheet material 32 and fasteners 34 and 36. Sheet material 32 is desirably configured as an integral unit having first and second sides 38 and 40, respectively. At the uppermost region of module 14, sides 38 and 40 have a common boundary 42. Since, in the preferred embodiments of the present invention, sides 38 and 40 are integrally formed into a single sheet material 32, no seam appears at boundary 42, but this is not a requirement. Those skilled in the art will appreciate that FIG. 4 shows a partial perspective view of tent network 10 (see FIGS. 1 and 2). Due to the flexible nature of sheet material 32, module 14 would not necessarily retain its shape, as shown in FIG. 4, absent attachment to two of tents 12**.

From boundary 42, each of sides 38 and 40 extends downward and outward toward the ground 44. This downward and outward slope increases the floor area under boundary 42 and trains rain away from the ground underneath connection module 14. In addition, this downward and outward slope from a common boundary 42 forms open ends 46 and 48 between edges 50 and 52 of sides 38 and 40. Each of sides 38 and 40 tapers so that open edges 50 and 52 each extend downward and inward with respect to boundary 42. Preferably, this downward and inward slope complements the above-discussed downward and outward slope of tents 12. That way, flexible sheet material 32 may be held taut to provide an aesthetically pleasing appearance and to prevent the formation of fabric puckers or pockets which might collect rain and cause a leak.

Fasteners 34 and 36 attach to sheet material 32 near open ends 46 and 48 thereof, respectively. Mating fasteners 54 attach to tent 12 near openings 30 thereof. Tents 12 are interconnected through connection module 14 by coupling fastener 34 of connection module 14 to fastener 54 of one tent 12 and coupling fastener 36 of connection module 14 to fastener 54 of another tent 12. The preferred embodiments use zippers to fasten connection module 14 to tents 12. Thus, fasteners 34, 36, and 54 represent zipper tracks in the preferred embodiments. However, other fastening devices, such as hook and loop fasteners, snaps, or the like, may be substituted for zippers.

In the embodiment of the present invention illustrated in FIGS. 3 and 4, connection module 14 has no floor. Thus, fastener 54 of tent 12 extends nearly to the ground 44. That way, lower ends 56 and 58 of sides 38 and 40, respectively, are held taut against tents 12 near the ground 44. Preferably, the distance between ends 50 and 52 of connection module 14 in the vicinity of lower ends 56 and 58 is in the three to six inch range. This relatively short distance causes tents 12 to reside near one another (see FIG. 1) and causes the distance spanned by flexible sheet material 32 in the vicinity of boundary 42 to be relatively short. Since the distance between tents 12 is so short, the absence of a floor has little effect on the function of connection module 14. An occupant may pass through connection module 14 from one tent 12 to another without stepping on the ground 44. Since the distance spanned by flexible sheet material 32 in the vicinity of boundary 42 is relatively short, no poles or other rigid members are needed to hold sheet material 32 taut in this vicinity. Consequently, connection module 14, as shown in FIGS. 3–4, may be manufactured and provided to tent users at relatively little cost.

Figure 5:
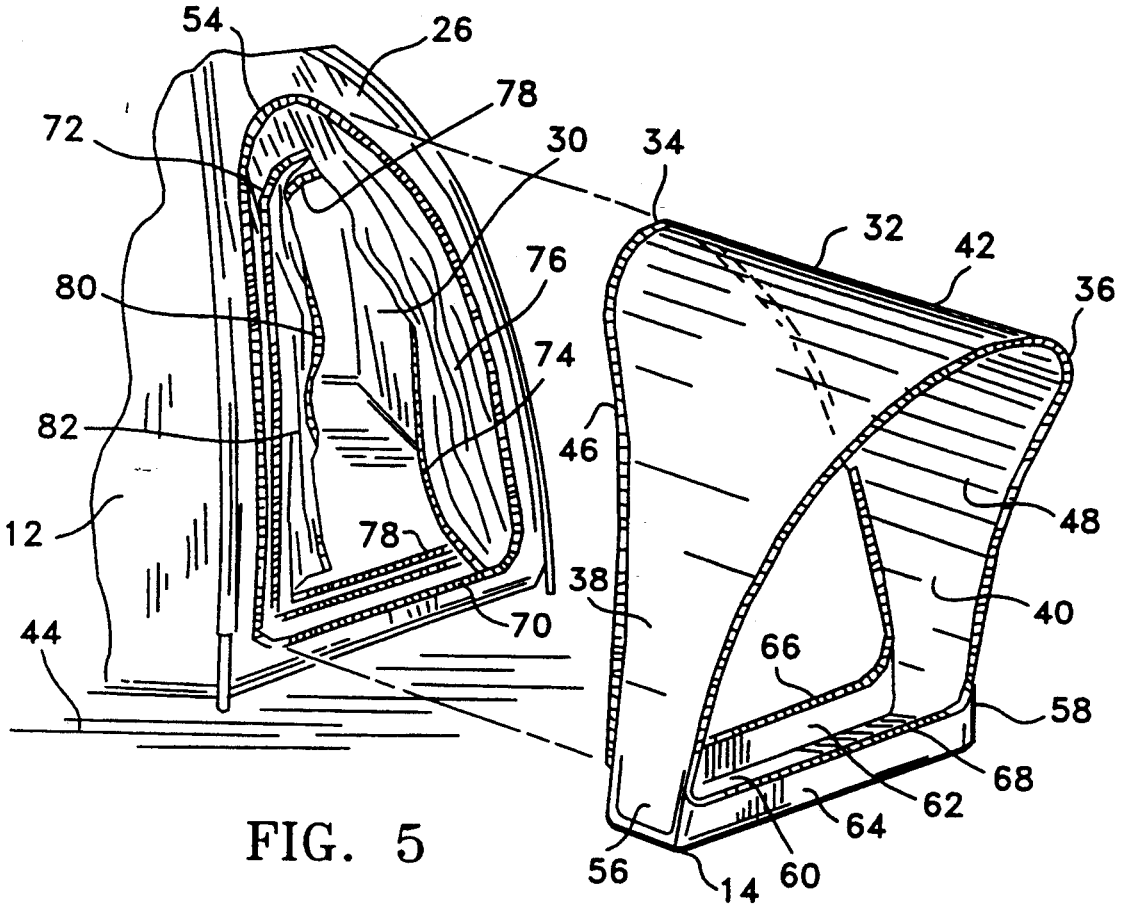
FIG. 5 shows an exploded partial perspective view of a stand-alone tent relative to a second embodiment of the connection module.

FIG. 5 shows a second embodiment of connection module 14*a* (see FIG. 1) and details of a tent 12 in the vicinity of an opening 30. The second embodiment of connection module 14 includes a generally horizontal floor panel 60 extending between lower ends 56 and 58 of first and second sides 38 and 40, respectively. Floor panel 60 is constructed from a flexible sheet material which may or may not be the same material as flexible sheet material 32. While floor panel 60 adds some small expense to connection module 14, it can improve cleanliness and protection from the elements within tent network 10 (see FIG. 2).

In addition, this second embodiment of connection module 14 includes raised panels 62 and 64, which attach to and extend upward from floor panel 60. Raised panels 62 and 64 extend across open ends 46 and 48 and also attach to sides 38 and 40, but raised panels 62 and 64 stretch upward from floor 60 for only a small distance. They are preferably constructed from a flexible sheet material. Fasteners 66 and 68 attach to raised panels 62 and 64, respectively, near their uppermost edges. Fasteners 66 and 68 couple to complementary fasteners 70, which attach to tents 12 slightly above the ground 44. As shown in FIG. 5, fasteners 66 and 34 may formed a single integral unit, fasteners 68 and 36 may formed a single integral unit, and tent fasteners 54 and 70 may form a single integral unit.

Raised panels 62 and 64 raise fasteners 66 and 68, respectively, and their mating fasteners 70 above the ground 44. This keeps the fasteners out of the dirt and improves their reliable and continued operation. In addition, raised panels 62 and 64 keep dirt and other items on the floor of one tent 12 of network 10 (see FIG. 1) from being easily tracked into other areas.

FIG. 5 further shows three separate fastening systems in the vicinity of opening 30 on tent 12. In the preferred embodiment of the present invention, all openings 30 include the three fastening systems, and each fastening system is either a zipper or a portion of a zipper. However, these are not requirements of the present invention. The outer fastening system includes fasteners 54 and 70, which were discussed above. Fasteners 54 and 70 mate with fasteners on a connection module 14.

An intermediate fastening system also resides near opening 30 of tent 12. This intermediate fastening system includes a first fastener 72 which resides near opening 30 on panel 26 of tent 12 and a second fastener, 74 which resides on an outer edge of a door panel 76 of tent 12. Door panel 76 is constructed from a flexible sheet material, preferably the same material as tent panels 26, and dimensioned to substantially cover opening 30, although FIG. 5 shows it in an open configuration. By mating first and second fasteners 72 and 74, door panel 76 is held in a closed configuration where it covers opening 30.

An inside fastening system also resides near opening 30 of tent 12. This inside fastening system includes a first fastener 78, which resides near opening 30 on panel 26 of tent 12 and a second fastener 80 which resides on an outer edge of a screen panel 82 of tent 12. Screen panel 82 is constructed from a permeable, generally transparent, screen-like flexible sheet material, and dimensioned to substantially cover opening 30. By mating first and second fasteners 78 and 80, screen panel 82 is held in a closed configuration where it covers opening 30.

In short, tents 12 desirably include screen panels 82 and door panels 76 in connection with openings 30 where connection modules 14 attach. This construction further improves the flexibility of tents 12 and tent network 10. A tent user may elect not to attach a connection module 14 to a tent 12, in which case opening 30 functions as a conventional tent doorway. When connection module 14 is attached to a tent 12, door panel 76 may be placed in its closed configuration to achieve privacy between tents. And, screen panel 82 may be placed in its closed configuration with door panel 76 open to let air circulate more freely and allow observation between the tents 12 while still defining discrete areas. For example, one tent may serve the role of a baby's play area. In this case, screen panel 82 may prevent a baby from wandering into other tents containing items that are potentially hazardous for a baby, while at the same time allowing the baby to be seen and heard by its care givers.

FIG. 5 shows each of door and screen panels 76 and 82 as being connected to panel 26 with a vertical seam or boundary therebetween. For convenience of illustration, FIG. 5 shows these seams as residing on opposing sides of opening 30. However, those skilled in the art will understand that the screen and door seams may advantageously both reside on a common side of opening 30, or that the seams may also reside in a generally horizontal orientation, preferably beneath opening 30.

Figure 6:
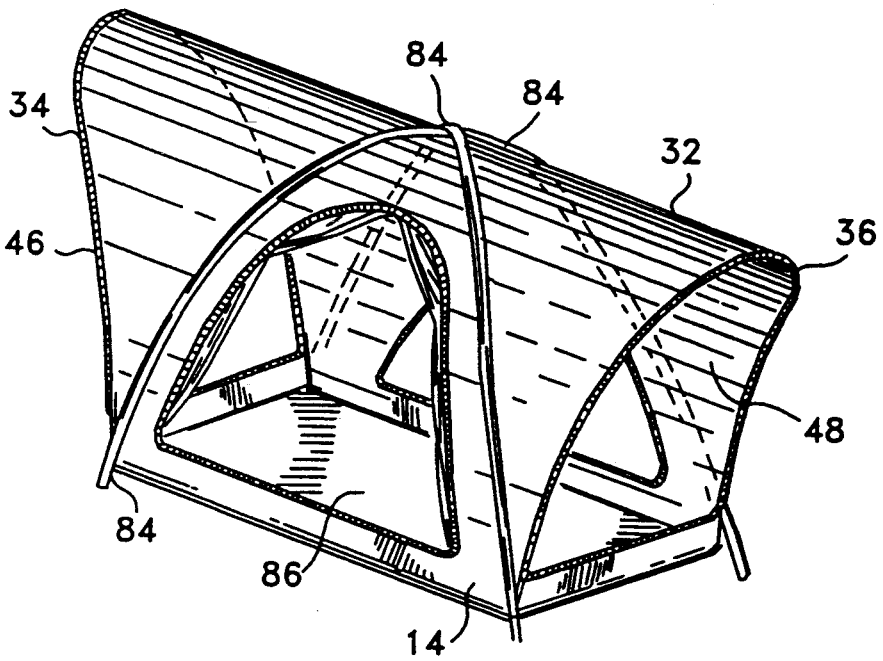
FIG. 6 shows a perspective view of a third embodiment of the connection module.

FIG. 6 shows a perspective view of a third embodiment of connection module 14, particularly connection module 14*b* (see FIG. 1). In the FIG. 6 embodiment, connection module 14 is longer between open ends 46 and 48 when compared to the embodiments of connection module 14 shown in FIGS. 3–5. This increased length allows tents 12 to be placed further apart for increased individual privacy. Due to the increased length, poles 84 are included and attached to flexible sheet material 32 to support the upper central region of module 14. In addition, a opening 86 is included to permit entry and exit. Although not shown in FIG. 6, opening 86 may be configured in a manner similar to openings 30 in tents 12. In other words, fasteners may be provided for attachment of other connection modules 14 along with screens and/or doors.

In summary, the present invention provides an improved tent system. The tent system uses stand-alone tents that may interconnect into a tent network. This allows the stand-alone tents to serve a wide variety of needs. The tent system of the present invention achieves great flexibility in configuring the tent network. The tent network may exhibit virtually any size and take on a vast assortment of shapes because each tent has at least two and preferably three doors. The assortment of doors provides many interconnection options. Connector modules may attach at any of the doors to best meet current user needs. At the same time, the flexibility achieved easily accommodates families or other groups needing more tent compartments, personal space, or private spaces for bathing, toileting, playing, sleeping, dressing, and the like. A tent network formed in accordance with the present invention achieves the closeness and comfort attributes of a single tent with the privacy attributes of separate tents.

The present invention has been described above with reference to preferred embodiments. However, those skilled in the art will recognize that changes and modifications may be made in these preferred embodiments without departing from the scope of the present invention. Moreover, those skilled in the art will understand that the directional terms used herein, such as up, down, uppermost, upward, downward, outward, inward, horizontal, and the like, are relative terms which are consistent with the orientations illustrated in the Figures. Those skilled in the art will appreciate that alternate orientations may be achieved. These and other changes and modifications which are obvious to those skilled in the art are intended to be included within the scope of the present invention.

What is claimed is:

1. A tent system for interconnecting a plurality of stand-alone tents into a tent network, said tent system comprising:

a flexible sheet material connection module having first and second sides with a common boundary therebetween, said common boundary being an uppermost portion of said sheet material, said first side sloping downward and outward from said common boundary and said second side sloping downward and outward from said common boundary so that said first and second sides have a substantially open end therebetween, said first and second sides being formed so that said open end slopes downward and inward from said common boundary; and connection module fastening means, attached to said first and second sides of said sheet material proximate said open end thereof, for removably attaching said flexible sheet material to a downward and outward sloping surface of a tent.

2. A tent system as claimed in claim 1 additionally comprising:

a tent having at least one surface sloping downward and outward from an uppermost region of said tent and having a tent opening formed in said surface and configured to permit occupant passage therethrough; and tent fastening means, attached to said tent proximate said tent opening, for coupling to said connection module fastening means.

3. A tent system as claimed in claim 2 wherein said at least one downward and outward sloping surface of said tent has a second opening formed therein, said second opening being configured to permit occupant passage therethrough.

4. A tent system as claimed in claim 3 wherein said at least one downward and outward sloping surface of said tent has a third opening formed therein, said third opening being configured to permit occupant passage therethrough.

5. A tent system as claimed in claim 2 additionally comprising:

a flexible door panel attached to said tent proximate said, tent opening and configured to selectively cover said tent opening;

a flexible screen panel attached to said tent proximate said tent opening and configured to selectively cover said tent opening;

a first door fastener attached to said door panel;

a second door fastener attached to said tent proximate said tent opening, said second door fastener being configured to couple to said first door fastener to hold said door panel in a closed configuration;

a first screen fastener attached to said screen panel; and a second screen fastener attached to said tent proximate said tent opening, said second screen fastener being configured to couple to said first screen fastener to hold said screen panel in a closed configuration.

6. A tent system as claimed in claim 2 wherein said first and second sides of said connection module additionally have a second open end therebetween and said first and second sides are further formed so that said second open end slopes downward and inward from said common boundary, and said tent system additionally comprises:

second connection module fastening means, attached to said first and second sides of said sheet material proximate said second open end thereof, for attaching said flexible sheet material to a downward and outward sloping surface of a second tent;

a second tent having at least one surface sloping downward and outward from an uppermost region of said second tent and having a second tent opening formed in said surface and configured to permit occupant passage therethrough; and second tent fastening means, attached to said second tent proximate said second tent opening, for coupling to said second connection module fastening means.

7. A tent system as claimed in claim 6 wherein said at least one downward and outward sloping surface of said second tent has a second opening formed therein, said second opening being configured to permit occupant passage therethrough.

8. A tent system as claimed in claim 7 additionally comprising:

a second flexible door panel attached to said second tent proximate said second tent opening and configured to selectively cover said second tent opening;

a second flexible screen panel attached to said second tent proximate said second tent opening and configured to selectively cover said second tent opening;

a third door fastener attached to said second door panel;

a fourth door fastener attached to said second tent proximate said second tent opening, said fourth door fastener being configured to couple to said third door fastener to hold said second door panel in a closed configuration;

a third screen fastener attached to said second screen panel; and a fourth screen fastener attached to said second tent proximate said second tent opening, said fourth screen fastener being configured to couple to said third screen fastener to hold said screen panel in a closed configuration.

9. A tent system as claimed in claim 1 wherein said first and second sides are formed together into an integral unit.

10. A tent system as claimed in claim 1 wherein said first and second sides each have lower ends opposing said common boundary, and said system additionally comprises a flexible sheet floor panel joined to said first side lower end and to said second side lower end to serve as a floor of said connection module.

11. A tent system as claimed in claim 10 additionally comprising:

a second flexible sheet panel positioned across said open end and joined to said first side, said second side, and said floor panel, said second flexible sheet panel extending only a portion of a distance which stretches between said floor panel and said common boundary; and second fastening means, attached to said second flexible sheet panel, for attaching said second flexible sheet panel to a tent.

12. A tent system as claimed in claim 1 wherein:

said first and second sides additionally form a second open end therebetween and said first and second sides are further formed so that said second open end slopes downward and inward from said common boundary; and said tent system additionally comprises second connection module fastening means, attached to said first and second sides of said sheet material proximate said second open end thereof, for attaching said flexible sheet material to a downward and outward sloping surface of a second tent.

13. A tent system as claimed in claim 1 wherein said connection module fastening means comprises a zipper track.

14. A tent system for interconnecting a plurality of stand-alone tents into a tent network, said tent system comprising:

a first stand-alone tent having first and second openings each of which is configured to permit occupant passage therethrough;

a second stand-alone tent having first and second openings each of which is configured to permit occupant passage therethrough; and a connection module removably coupled to said first tent at said first opening thereof and removably coupled to said second tent at said first opening thereof, said connection module being formed from a flexible sheet material and being dimensioned to permit occupant passage therethrough, and said connection module including:

a flexible sheet material having first and second sides with a common boundary therebetween, said common boundary being an uppermost portion of said sheet material, said first side sloping downward and outward from said common boundary and said second side sloping downward and outward from said common boundary so that said first and second sides have opposing first and second substantially open ends therebetween, said first and second sides being formed so that said first and second open ends each slope downward and inward from said common boundary;

first connection module fastening means, attached to said first and second sides of said sheet material proximate said first open end thereof, for attaching said flexible sheet material to said first tent; and second connection module fastening means, attached to said first and second sides of said sheet material proximate said second open end thereof, for attaching said flexible sheet material to said second tent.

15. A tent system as claimed in claim 14 wherein:

said first tent has at least one surface sloping downward and outward from an uppermost region of said first tent, said first opening of said first tent resides in said first tent surface, and said first tent additionally has first tent fastening means, attached to said first tent proximate said first tent first opening, for coupling to said first connection module fastening means; and said second tent has at least one surface sloping downward and outward from an uppermost region of said second tent, said first opening of said second tent resides in said second tent surface, and said second tent additionally has second tent fastening means, attached to said second tent proximate said second tent first opening, for coupling to said second connection module fastening means.

16. A tent system as claimed in claim 15 wherein:

said first tent has a third opening formed therein, said third opening being configured to permit occupant passage therethrough; and said second tent has a third opening formed therein, said third opening being configured to permit occupant passage therethrough.

17. A tent system as claimed in claim 15 additionally comprising:

a first flexible door panel attached to said first tent proximate said first tent first opening and configured to selectively cover said first tent first opening;

a first flexible screen panel attached to said first tent proximate said first tent first opening and configured to selectively cover said first tent first opening;

a first door fastener attached to said first door panel;

a second door fastener attached to said first tent proximate said first tent first opening, said second door fastener being configured to couple to said first door fastener to hold said first door panel in a closed configuration;

a first screen fastener attached to said first screen panel;

a second screen fastener attached to said first tent proximate said first tent first opening, said second screen fastener being configured to couple to said first screen fastener to hold said first screen panel in a closed configuration;

a second flexible door panel attached to said second tent proximate said second tent first opening and configured to selectively cover said second tent first opening;

a second flexible screen panel attached to said second tent proximate said second tent first opening and configured to selectively cover said second tent first opening;

a third door fastener attached to said second door panel;

a fourth door fastener attached to said second tent proximate said second tent first opening, said fourth door fastener being configured to couple to said third door fastener to hold said second door panel in a closed configuration;

a third screen fastener attached to said second screen panel; and a fourth screen fastener attached to said second tent proximate said second tent first opening, said fourth screen fastener being configured to couple to said third screen fastener to hold said second screen panel in a closed configuration.

18. A tent system for interconnecting a plurality of stand-alone tents into a tent network, said tent system comprising:

a flexible sheet material connection module having first and second side walls with first and second opposing substantially open ends therebetween, said connection module having first connection module fastening means, attached to said first and second sides of said sheet material proximate said first open end thereof and second connection module fastening means, attached to said first and second sides of said sheet material proximate said second open end thereof;

a first stand-alone tent having:

side walls with first and second openings each of which is configured to permit occupant passage therethrough;

a first flexible door panel attached to said first tent side walls proximate said first tent first opening and configured to selectively cover said first tent first opening;

a first door fastener attached to said first door panel;

a second door fastener attached to said first tent side walls proximate said first tent first opening, said second door fastener being configured to couple to said first door fastener to releasably hold said first door panel in a closed configuration;

a first flexible screen panel attached to said first tent side walls proximate said first tent first opening and configured to selectively cover said first tent first opening;

a first screen fastener attached to said first screen panel;

a second screen fastener attached to said first tent side walls proximate said first tent first opening, said second screen fastener being configured to couple to said first screen fastener to releasably hold said first screen panel in a closed configuration;

a connection module fastener attached to said first tent side walls proximate Said first tent first opening, said first tent connection module fastener being configured to couple to said first tent connection module fastening means to releasably attach said connection module to said first tent; and a second stand-alone tent having:

side walls with first and second openings each of which is configured to permit occupant passage therethrough;

a second flexible door panel attached to said second tent sidewalls proximate said second tent first opening and configured to selectively cover said second tent first opening;

a third door fastener attached to said second door panel;

a fourth door fastener attached to said second tent side walls proximate said second tent first opening, said fourth door fastener being configured to couple to said third door fastener to releasably hold said second door panel in a closed configuration;

a second flexible screen panel attached to said second tent sidewalls proximate said second tent first opening and configured to selectively cover said second tent first opening;

a third screen fastener attached to said second screen panel;

a fourth screen fastener attached to said second tent side walls proximate said second tent first opening, said fourth screen fastener being configured to couple to said third screen fastener to releasably hold said second screen panel in a closed configuration; and a connection module fastener attached to said second tent side walls proximate said second tent first opening, said second tent connection module fastener being configured to couple to said second tent connection module fastening means to releasably attach said connection module to said second tent.

19. A tent system as claimed in claim 18 wherein:

said first tent has a third opening formed in said first tent side walls, said third opening being configured to permit occupant passage therethrough; and said second tent has a third opening formed in said second tent side walls, said third opening being configured to permit occupant passage therethrough.

* * * * *